United States Patent [19]

Spitaler et al.

[11] Patent Number: 4,465,294

[45] Date of Patent: Aug. 14, 1984

[54] SAFETY SKI BINDING

[75] Inventors: Englebert Spitaler, W. Neudorf; Gerhard Oberleitner; Theodor Nitschko, both of Vienna, all of Austria

[73] Assignee: TMC Corporation, Baar, Switzerland

[21] Appl. No.: 345,109

[22] Filed: Feb. 2, 1982

[30] Foreign Application Priority Data

Feb. 13, 1981 [AT] Austria ..... 685/81

[51] Int. Cl.[3] ..... A63C 9/08

[52] U.S. Cl. ..... 280/612

[58] Field of Search ..... 280/611, 612, 613, 626; 180/170; 340/870.27, 870.31

[56] References Cited

U.S. PATENT DOCUMENTS

| | | | |
|---|---|---|---|
| 3,919,563 | 11/1975 | Lautrer | 280/612 |
| 4,101,870 | 7/1978 | Ekman | 180/170 |
| 4,156,534 | 5/1979 | Salomon | 280/612 |
| 4,340,243 | 7/1982 | Spademan | 280/611 |
| 4,361,344 | 11/1982 | Hull | 280/612 |
| 4,371,188 | 2/1983 | Hull | 73/862.04 |

FOREIGN PATENT DOCUMENTS

| | | | |
|---|---|---|---|
| 2519544 | 11/1975 | Fed. Rep. of Germany | 280/612 |
| 2726143 | 1/1978 | Fed. Rep. of Germany . | |
| 1514492 | 6/1978 | United Kingdom . | |

OTHER PUBLICATIONS

Hull, "Computers in Your Skiing Future", Spring 1979 from Engineering Progress, vol.5, No.1.

Hull and Allen, "Design of an Actively Controlled Snow Ski Release Binding", ASME 138, vol. 103, No. 3, (Aug. 1981).

*Primary Examiner*—Joseph F. Peters, Jr.

*Assistant Examiner*—Michael Mar

*Attorney, Agent, or Firm*—Flynn, Thiel, Boutell & Tanis

[57] ABSTRACT

A safety ski binding includes a jaw for releasably holding a ski boot sole, which jaw has strain sensors which produce electrical signals in response to forces exerted on the jaw and an electrically operated release mechanism. A plug board provided in the jaw behind a protective cover is connected electrically to a control circuit which is responsive to the strain sensors and controls the release mechanism. A replaceable plug-in unit insertable in the plug board determines the release characteristics of the jaw on the basis of the skier's ability level and personal characteristics. In one embodiment, the plug-in unit contains fixed circuit components which define the ability level and variable circuit components adjustable to define the personal characteristics. In another embodiment, the plug-in unit contains a program storage or a micro-processor which defines the ability level and personal characteristics.

4 Claims, 5 Drawing Figures

SAFETY SKI BINDING

FIELD OF THE INVENTION

This invention relates to a safety ski binding and, more particularly, to a binding having an electronic circuit which has a release mechanism and an evaluating arrangement which processes electrical signals corresponding to loads exerted on the binding and controls the release machanism, into which circuit can be fed data for the user which determines the release criteria.

BACKGROUND OF THE INVENTION

In such ski bindings, it is common to build the electrical circuit in its entirety on a carrier and to arrange it within a jaw of the binding. To adjust the release values of the binding to the user, structural parts with adjustable values are arranged on the carrier and can be adjusted either directly, by means of a screw driver introduced through closable bores of the jaw housing, or through transfer elements rotatably held in the jaw housing and operated by means of a screw driver or the like.

A particular disadvantage of such a design is that the structural parts with adjustable values, in comparison to structural parts with fixed values, have drastically increased susceptibility to error. In the case of an error of these structural parts, which at any rate are susceptible to breakdown, for purposes of repair the entire carrier with the electronic circuit must be removed, with which is associated considerable expense.

A goal of the invention is thus to provide a binding of the above-mentioned type which avoids the above disadvantages, and in particular, in which the structural parts which are most susceptible to breakdown are easily accessible and exchangeable.

SUMMARY OF THE INVENTION

Inventively, this is achieved by providing on the binding a mounting which is connected to the electrical circuit and is preferably arranged under a closeable and, if desired, transparent cover for receiving a plug-in unit which preferably is provided with plugs and has structural parts for storing data specific to the user. With this, breakdowns, caused in the majority of the cases by damage to the adjustable structural parts, can be overcome quickly and simply by exchanging the plug-in unit.

A particularly advantageous form of the inventive construction results in bindings in which the release criteria also take into account the characteristics with respect to time of the loads applied to the jaw in order to adjust the release characteristic of the binding to the requirements of various groups of skiers like beginning, advanced, sport and racing skiers. In these cases, it was necessary up to now to design the circuit which is built into the binding for the desired group of skier, so that for each group of skiers a separate binding or separate circuit had to be provided or, alternatively, structural parts which determine the characteristics with respect to time of the release operation had to be those with adjustable values, which again results in a considerable increase in the susceptibility to breakdown.

According to a further characteristic of the invention, a safety ski binding is provided in which the release criteria take into account the characteristics with respect to time of the loads applied to the jaw, and wherein structural parts with fixed values which are adjusted to certain groups of skiers like beginners and racing skiers and which determine the reaction dynamics of the release, and structural parts with adjustable values which serve the entry of specific personal data like weight and tibia size are arranged on the plug-in unit. This makes it possible in a very simple manner to adapt the binding, through the selection of a suitable plug-in unit, for the desired group of skiers, whereby a small number of structural parts with adjustable values, provided only to serve the necessity for adjustment to personal specific data like weight, tibia size and shoe sole length, is sufficient.

In this connection, it is particularly advantageous if the structural parts which determine the time constants of two integrators which are associated with respective signals which correspond with the loads which occur in two normal planes and of one summing amplifier which is connected to the outputs of the two integrators, the coupling resistors for connecting the integrators to the summing amplifier, and the structural parts which determine the switching threshold of a threshold switch which is connected to the output of the summing amplifier are all arranged on the plug-in unit, whereby only the structural parts which determine the switching threshold and are associated with specific personal data like tibia size and weight are adjustable in value.

According to a further characteristic of the invention, it is provided that a program storage or a micro-processor which is programmed according to the specific characteristics and possibly the ability level of the user is arranged on the plug-in unit, which program storage or micro-processor is advantageously connected to a separate plug device. In this case, aside from the advantage of the good accessibility of the parts which control the release, there is also the advantage that a manipulation of the personal data by the user is virtually impossible. When the program storage or the micro-processor is connected to the separate plug mechanism, it is also possible to program same through a cable from a programming desk.

BRIEF DESCRIPTION OF THE DRAWINGS

The invention will now be described in greater detail in connection with the drawings, in which.

DETAILED DESCRIPTION

The subject matter of this application is related to the subject matter of a copending application entitled "SAFETY SKI BINDING," U.S. Ser. No. 315,671, filed Oct. 27, 1981, the disclosure of which is incorporated herein by reference.

Figure 1:
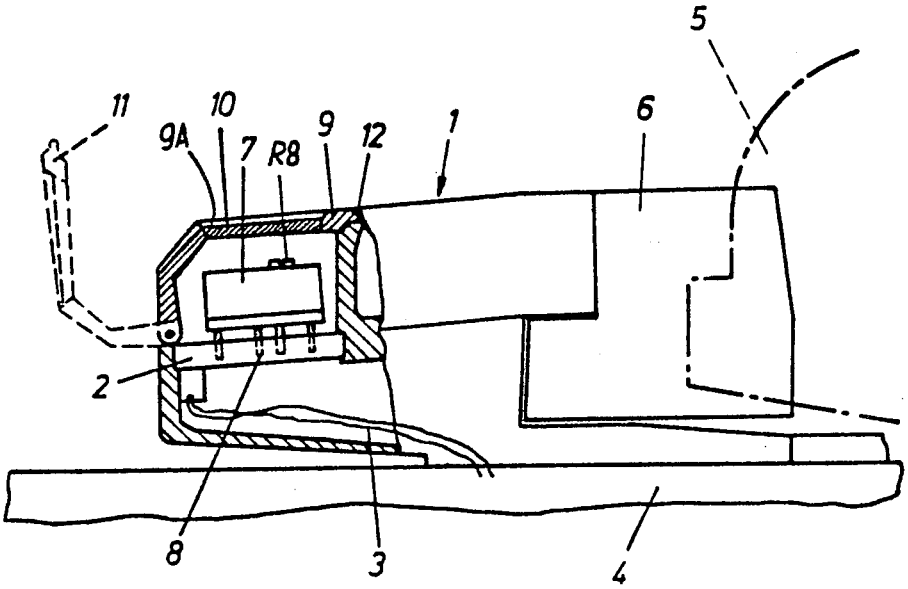
FIG. 1 is a fragmentary side view of an inventive ski binding jaw.
Figure 2:
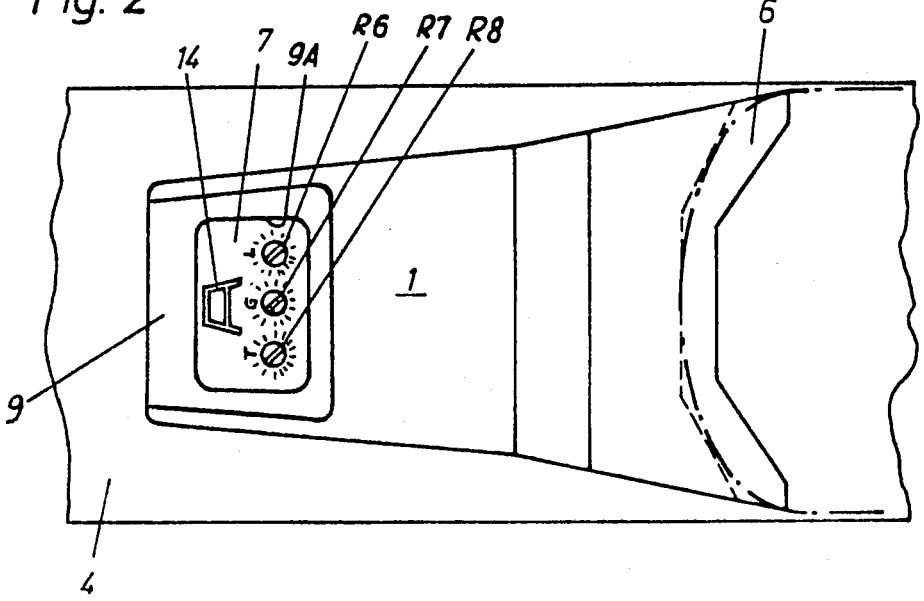
FIG. 2 is a top view of the jaw of FIG. 1.

A mounting which is formed by a plug board 2 is arranged in the front portion of the jaw 1 in the embodiment according to FIGS. 1 and 2, which mounting is electrically connected by wires or lines 3 to an electronic circuit which is not illustrated in FIG. 1 and is preferably arranged in a cavity in the ski 4. This circuit electrically controls in a known manner the release of the jaw 1 and thus the release of a ski shoe 5 which is held by the jaw 1. Furthermore, conventional devices on the jaw which in a known manner measure the forces acting on the jaw 1 and produce electrical signals which are dependent on such forces are connected to the electronic circuit, and the jaw release mechanism which is controlled by the electronic circuit is stored in the jaw 1 and releases the sole holder 6 in the case of occurrence of forces dangerous to the skier.

A plug-in unit 7 is plugged into the mounting which is formed by the plug board 2, which plug-in unit can store specific personal data of the user and also contains structural parts with fixed values which influence the release characteristic of the electronic circuit, which values are selected to adjust the jaw release characteristics to the ability levels of certain groups of skiers like beginning, advanced, sport and racing skiers.

The plug board 2 has conventional and not illustrated electrical contacts thereon which are each connected electrically to a respective one of the lines 3. The plug-in unit 7 has plug contacts 8 thereon which, when the plug-in unit 7 is plugged into the plug board 2, respectively engage the electrical conacts of the plug board 2, thereby effecting electrical connection of a circuit in the plug-in unit 7 with the lines 3. The plug board 2 could, for example, be a conventional printed circuit board carrying sockets for the plug contacts 8.

The mounting and the plug-in unit 7 which is plugged therein and is connected through the plug contacts 8 and the lines 3 to the electronic circuit can be protected by means of a cover 9 which is pivotally supported on the jaw 1 and is provided with an opening 9A carrying a transparent insert or window 10. The cover 9 has a projecting bar 11 which can engage through elastic deformation a corresponding groove 12 which is provided in the jaw 1, in order to secure the cover 9 in its closed position.

As can be seen from FIG. 2, the plug-in unit 7 has three structural parts which can be adjusted, are identified with symbols T, G and L, are preferably potentiometers or adjusting resistors R6, R7 and R8, and are provided for storing specific personal data of the user such as tibia size, weight, and shoe sole length. Furthermore, the plug-in unit 7 is provided with a symbol designated by reference numeral 14 which identifies the group of skiers for which the plug-in unit 7 is preset.

Figure 3:
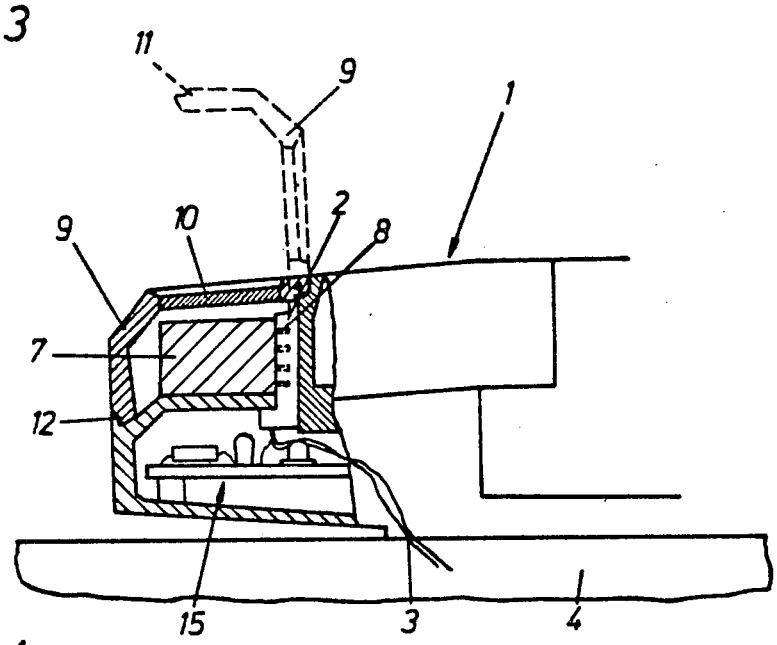
FIG. 3 is a fragmentary side view of a further embodiment of the jaw of FIG. 1.

In the modification according to FIG. 3, the mounting which is formed by the plug board 2 is also arranged in the front portion of the jaw 1, and the cover 9 with the transparent insert 10 is also provided. However, the plug board 2 is arranged vertically. The plug-in unit 7 which is insertable in the plug board 2 is connected by its plug contacts 8 and the lines 3 to the electronic circuit 15, which in this embodiment is arranged in the jaw 1.

Figure 4:
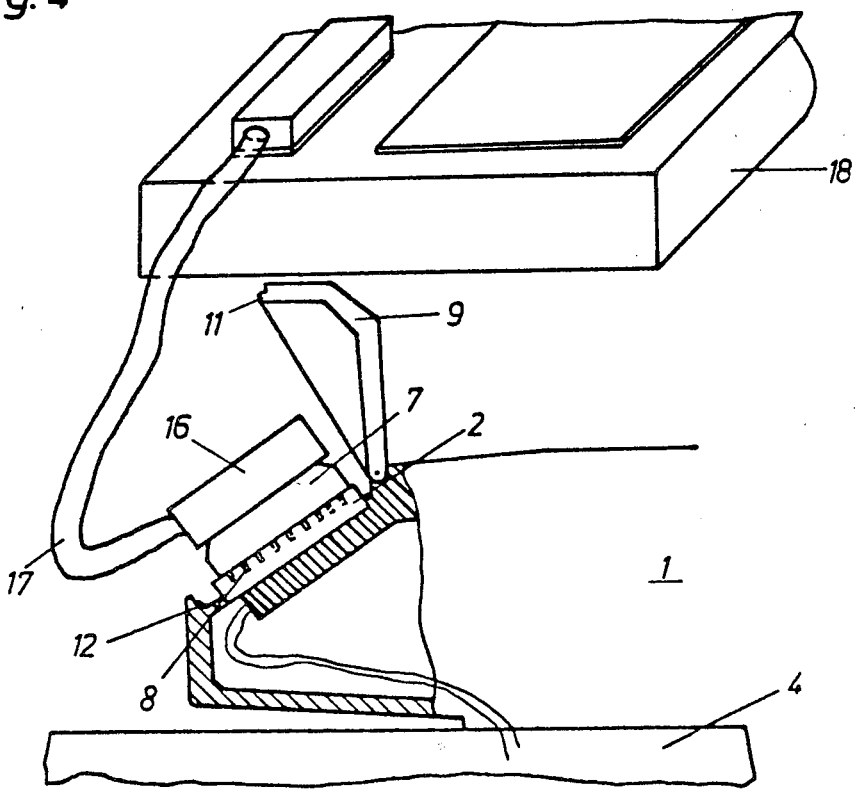
FIG. 4 is a fragmentary side view of a further embodiment of the jaw of FIG. 1 and a perspective view of an associated programming desk.

A further exemplary embodiment is illustrated in FIG. 4. The plug-in unit 7 which is plugged into the plug board 2 in this embodiment includes a program storage which can be connected through a plug 16 and lines 17 to a program desk 18, through which the programming input occurs to store data in the unit 7 corresponding with the personal characteristics of the user. From this results the advantage that manipulation thereof by the user is not possible.

Figure 5:
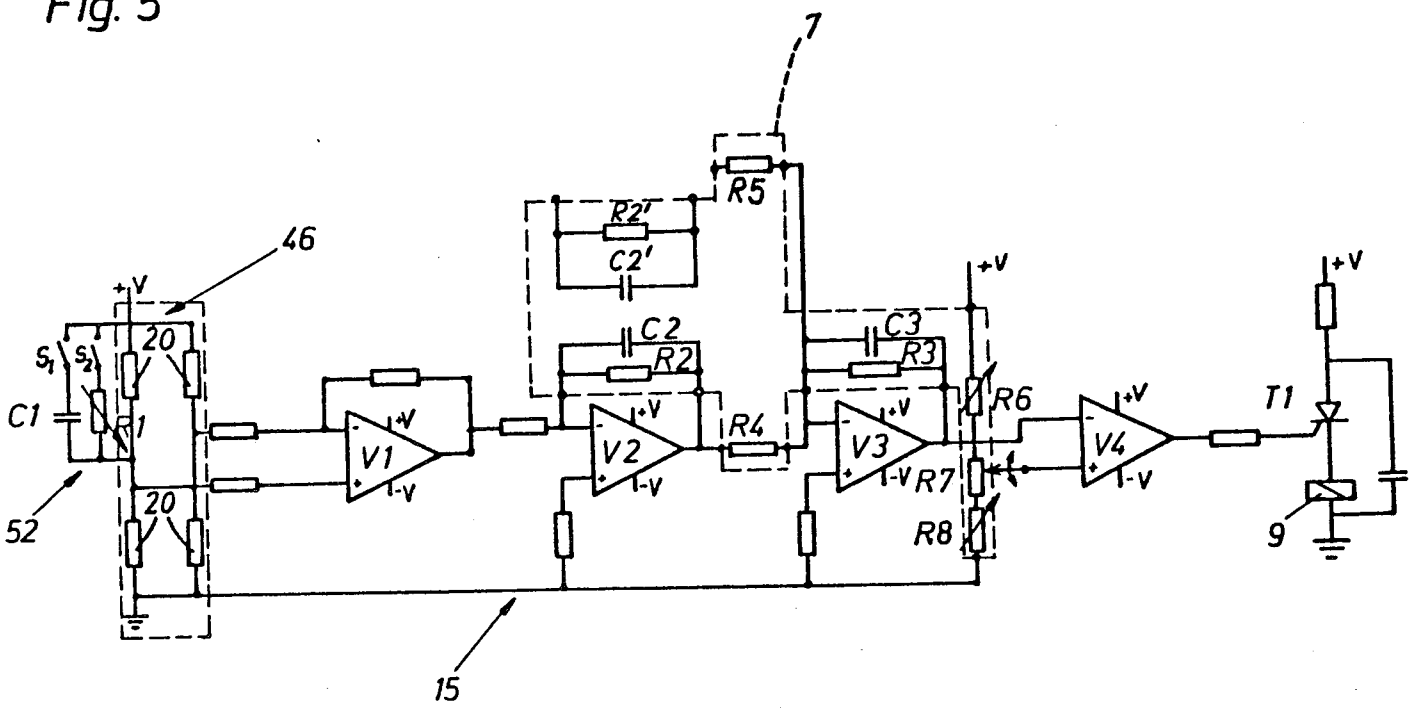
FIG. 5 is a schematic diagram of an exemplary electronic circuit which is part of the jaw of FIG. 1 and in which structural parts which are arranged on a plug-in unit are emphasized.

FIG. 5 schematically illustrates an exemplary circuit arrangement with a function-control circuit for an electrically releasable safety ski binding such as that in FIG. 1, wherein the circuit in the plug-in unit 7 is indicated by broken lines.

The function-control circuit 52 is formed by a selectively adjustable resistor R1 and capacitor C1 which influence a signal converter 46 formed by a bridge circuit of four conventional resistive wire strain sensors 20 which emit electrical signals in response to forces acting on the jaw. For satisfactory functioning, no release occurs when switch S1 connects the capacitor C1 into the circuit, but a release occurs when switch S2 connects the resistor R1 into the circuit. The switches S1 and S2 are provided for controlling the operation of the circuit of FIG. 5 and should be closed by the skier one after the other before using the binding. They should both be open when the binding is used. The signal from the bridge circuit is amplified by the amplifier V1 and is fed to the integrator V2. The R-C network R2 and C2 which lies in the feedback path of the integrator V2 and the output resistor R4 of the integrator V2 which is connected to the summing amplifier V3 are, just like the feedback network R3 and C3 for the summing amplifier V3 and the coupling resistor R5 of a second, not illustrated and identically designed channel, arranged on the plug-in unit 7 which serves as an exchangeable program storage. Also, an R-C network R2′ and C2′ which is provided for the feedback path of the integrator of the not illustrated identical circuit is arranged on the plug-in unit 7. Thus, depending on which group of skiers the user belongs to, for example a beginning or sport skier, the appropriate signal amplification and dynamic release characteristics can be established. The second channel can, for example, process forces which act onto the other jaw of the binding or, alternatively, one channel can process the forces which act horizontally onto one or both jaws and the second channel can process the forces which act vertically onto one or both jaws. In every case, the resulting signals are summed in the summing amplifier V3 and are fed to the amplifier V4 which acts as a threshold switch, the switching threshold of which is determined by the adjustable resistors R6, R7 and R8 which provide the storage for user specific data such as tibia size, weight, and shoe sole length. These resistors are also arranged on the plug-in unit 7.

The output stage which is connected with the threshold switch or amplifier V4 is formed substantially by a thyristor T1 which controls the coil 9 of a conventional solenoid which in turn controls the mechanical release of the jaw.

The circuit elements V1 to V4 in FIG. 5 are preferably conventional components such as those marketed under part number LM10B by National Semiconductor Corporation, and the thyristor T1 is also preferably a conventional component such as that marketed under part number BRY 55160 by Siemens AG of Munich, Germany.

A not illustrated battery is provided for supplying current to all circuitry.

Although a particular preferred embodiment of the invention has been disclosed in detail for illustrative purposes, it will be recognized that variations or modifications of the disclosed apparatus, including rearrangement of parts, lie within the scope of the present invention.

The embodiments of the invention in which an exclusive property or privilege is claimed are defined as follows:

1. In a safety ski binding which includes electrically actuated release means for releasably holding a ski shoe, sensor means for producing first and second electrical signals in response to respective forces urging movement of said ski shoe relative to said binding in respective directions which are approximately perpendicular to each other, and an electrical circuit having evaluating means responsive to said first and second electrical signals from said sensor means for controlling said release means, said evaluating means including two integrators which each have as an input a respective one of said first and second electrical signals, a summing amplifier which is connected to an output of each of said integrators, a first group of circuit components which are coupled to and define a switching threshold for a threshold switch which is connected to an output of said summing amplifier and which controls said release means, and a second group of circuit components which are coupled to and define time constants for said integrators and said summing amplifier, said first and second groups of circuit components being selected in dependence on selected physical characteristics of a particular skier using said binding, the improvement comprising wherein said binding includes a mounting which is electrically connected to said electrical circuit and is adapted to removably receive and to be electrically coupled to a plug-in unit, wherein said plug-in unit has thereon a portion of said electrical circuit, said portion including said first and second groups of circuit components, and wherein said circuit components of said second group are fixed in value and said circuit components of said first group are adjustable in value.

2. The safety ski binding according to claim 1, wherein said binding includes a housing having means defining a recess therein and a cover supported on said housing for movement between open and closed positions in which said cover respectively facilitates and obstructs access to said recess, wherein said mounting is arranged in said recess in said housing, and wherein said plug-in unit can be manually coupled to and removed from said mounting when said cover is in said open position.

3. The safety ski binding according to claim 2, wherein at least a portion of said cover is transparent.

4. The safety ski binding according to claim 1, wherein said first group of circuit components includes three said circuit components which are respectively adjusted in value in dependence on the skier's tibia size, weight, and shoe sole length.

* * * * *